United States Patent [19]

LeFevere

[11] 4,439,080

[45] Mar. 27, 1984

[54] BINDER CLAMP SPRING SAFETY DEVICE

[75] Inventor: Robert E. LeFevere, Memphis, Tenn.

[73] Assignee: American Standard Inc., New York, N.Y.

[21] Appl. No.: 372,505

[22] Filed: Apr. 28, 1982

[51] Int. Cl.[3] ..... B42B 9/00

[52] U.S. Cl. ..... 412/9

[58] Field of Search ..... 408/132, 6; 412/9, 12, 412/16

[56] References Cited

U.S. PATENT DOCUMENTS

| | | | |
|---|---|---|---|
| 1,981,147 | 11/1934 | Moller | 408/6 |
| 3,989,405 | 11/1976 | Quackenbush | 408/132 X |
| 3,998,565 | 12/1976 | Tanaka | 408/132 |

*Primary Examiner*—Paul A. Bell
*Assistant Examiner*—John S. Brown
*Attorney, Agent, or Firm*—Robert G. Crooks; James J. Salerno, Jr.; John P. Sinnott

[57] ABSTRACT

This safety device for binding machines, which prevents broken clamp locking mechanism springs from engaging and damaging roughing and trimming saw blades or the clamp carrier cam, provides a collar-like means to be securely mounted on the shaft which supports the lower end of the clamp spring. Anchored to the collar are two protruding pins which project on either side of the clamp spring to provide supports upon which the broken segement of spring may rest rather than dangling into the saw blades or coming into contact with the clamp carrier cam.

1 Claim, 5 Drawing Figures

FIG. 2
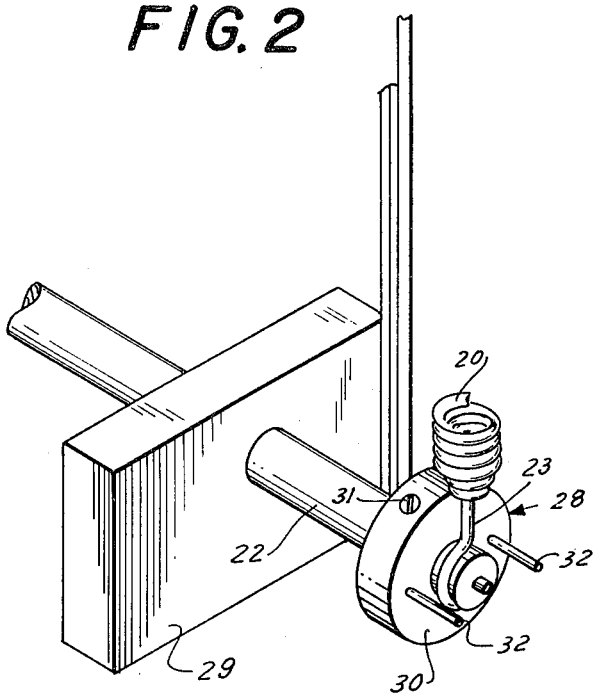
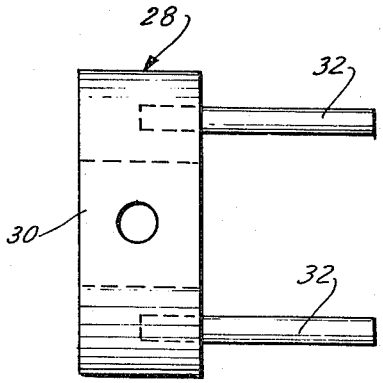
FIG. 3

BINDER CLAMP SPRING SAFETY DEVICE

TECHNICAL FIELD

This invention pertains to binding machines, which, during the binding process, clamp a group of signatures together and saw off a portion of the signatures prior to binding them into a book, and more particularly, to a device to prevent damaging of the saw blades or clamp carrier cam by a broken clamp holding spring.

BACKGROUND ART

In binding machines it is often customary to hold groups of signatures together in a series of mechanical clamps. (A signature is a large sheet of paper printed with four or a multiple of four pages, which, when folded, becomes a section of a book or magazine.) The clamps holding the signatures are advanced along a predetermined path to engage cutting and roughing saw blades by which the clamped signatures are cut along the edge which is to become the binding edge.

When clamping is accomplished the signature group is held in place by means of a spring biased clamp locking mechanism. The upper portion of the spring may be attached to an operating lever which controls locking and unlocking of the clamp, and the lower portion of the spring may be attached to a shaft, by means of hook-shaped elements extending from the spring body.

These clamp springs undergo a high rate of flexing, often several hundred times per hour. Due to this high rate of flexing, the springs sometimes break. When a spring fails, recoil can cause the remaining portion of the spring attached to the lower shaft to rotate either inwardly or outwardly. When a spring fails near its lower end attachment, the remaining spring segment attached to the shaft will swing down and hang from the hook-shaped element. As the clamp moves over the trimming and roughing saws, the saw blades and their plastic guard are damaged or destroyed. In the event a spring fractures near the top end attachment, if it rotates outwardly it will hang down and damage the saw blades; if it rotates inwardly it may contact the clamp carrier cam. Contact of the cam surface by the sharp end of a broken spring could render the cam useless. (The clamp carrier cam maintains alignment of the clamps throughout the clamping and trimming process. Each clamp is held to the cam surface by cam rollers. The cam surface must be perfectly smooth or damage to the cam rollers could occur.)

In addition to the damage to expensive machinery and the loss of productivity due to down time, operating personnel are in danger of being gravely injured by flying fragments of the saw blade and the plastic guard in the critical moments between the time the damage occurs to the machine and the stopping of the machine.

DISCLOSURE OF THE INVENTION

Accordingly, it is an object of this invention to retain the broken spring segment in a position which will not allow contact with the saw blades or the clamp carrier cam.

Briefly, this object is accomplished by the invention by means of a collar-like element which is positioned around the shaft which supports the lower end of the clamp spring. The collar-like element has two pins which extend from it towards the spring, one on either side of the spring. If the spring breaks, one of the pins, both of which extend across the path of the spring, will support the broken segment of spring attached to the shaft, whether it rotates inwardly or outwardly, and thus prevent it from dangling into the saw blades or coming into contact with the clamp carrier cam.

The features and advantages of the invention are expressed in more complete detail in the following description of a specific embodiment of the invention. The scope of the invention, however, is limited only by the claims.

BRIEF DESCRIPTION OF THE DRAWINGS

FIG. 2 is a fragmentary perspective view of the lower end of the spring attached to the shaft.

FIG. 3 is a side elevation of the clamp spring safety device.

DETAILED DESCRIPTION OF THE PREFERRED EMBODIMENT

Figure 1:
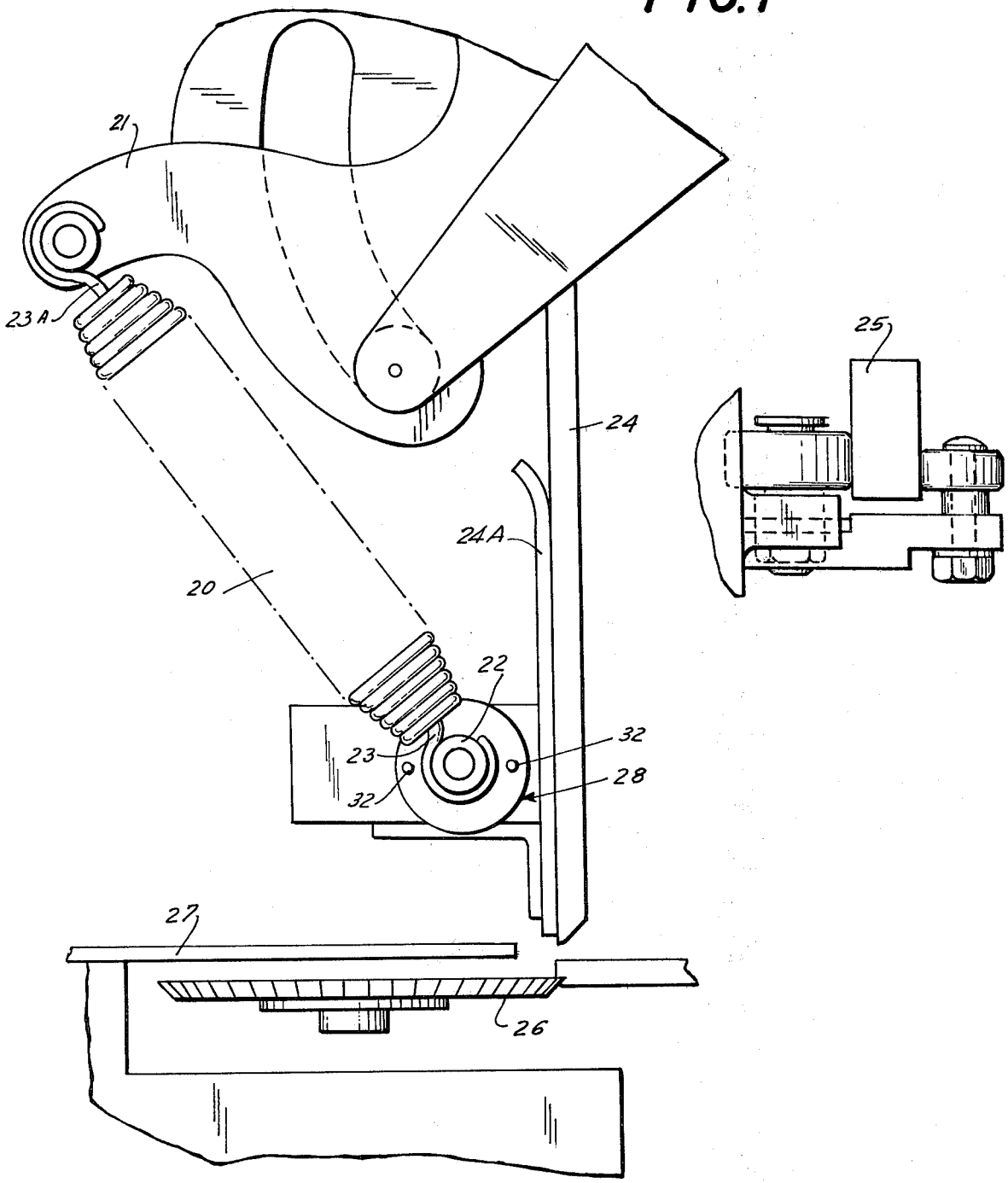
FIG. 1 is a side elevation showing the whole clamp spring attached to the shaft and the operating lever.

For a more thorough understanding of the invention, attention is invited to FIG. 1, which shows a portion of a binding machine including clamp spring 20 attached to the operating lever 21 and the shaft 22 by means of hook-shaped elements 23 and 23A. Positioned to the side of the clamp spring 20 is the clamp plate 24, the curved plate 24A, and the clamp carrier cam 25, that portion of the clamp carrier structure not pertinent to the invention being eliminated from the drawing. Positioned below the clamp spring 20 is the saw 26. A plastic guard 27 is positioned above the saw 26.

The clamp spring safety device 28 is best shown in FIG. 2. The body 30, which may be a torus made of $1\frac{7}{8}''$ cold rolled steel and may be $\frac{3}{4}''$ thick, fits snugly, as a collar, around the shaft 22 between the clamp spring 20 and the shaft bushing block 29 by means of set screws 31. (Only one set screw is visible in the drawing. The other set screw is placed 180 degrees from the visible one.) The clamp spring safety device 28 is placed close to but not contacting the clamp spring 20 and the hook-shaped element 23. Two pins 32, which may be $3/16'' \times 1\frac{1}{2}''$ roll pins, are anchored in the body 30, as best shown in FIG. 3. Returning to FIG. 2, it can be seen that the pins 32 project on either side of and beyond the plane of the clamp spring 20.

Figure 4:
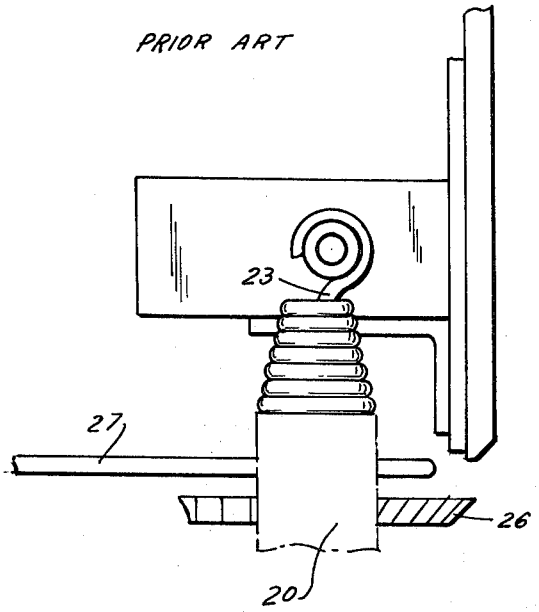
FIG. 4 is a fragmentary side elevation of a broken clamp spring segment dangling from its mooring on the shaft.

Turning to FIG. 4, in which the invention is not shown, a broken clamp spring 20 is dangling from hook-shaped element 23 into the path of the saw 26 and the plastic guard 27.

Figure 5:
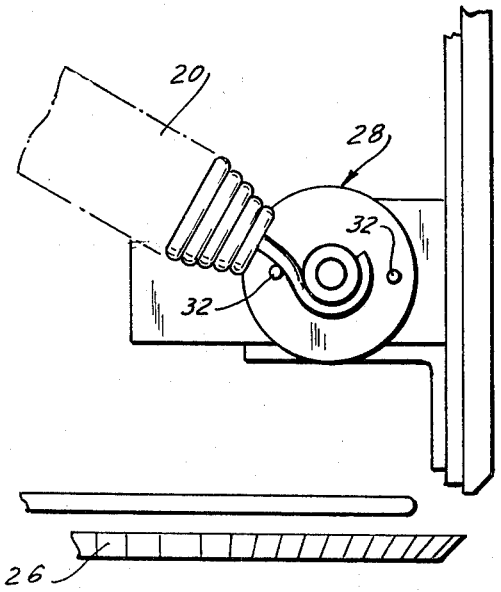
FIG. 5 is a fragmentary side elevation showing a broken clamp spring segment resting upon the clamp spring safety device, in accordance with the invention.

In FIG. 5, and in accordance with the invention, the pins 32 of the clamp spring safety device 28 have prevented the broken segment of the clamp spring 20 from dangling into the path of the saw 26. The broken segment of the clamp spring 20 rests on one of the pins 32.

Thus, there is provided a simple and inexpensive means of protecting personnel from flying fragments of saw blades and expensive machinery from damage and down time.

What is claimed is:

1. A binder clamp spring safety device for restraining a segment of a failed binding machine clamp spring in combination with a binding machine comprising a cutting and roughing saw, a clamp plate and a curved plate spaced from said saw, a clamp carrier cam spaced from said clamp plate, a shaft bushing block secured to said curved plate, a shaft protruding from said block, a clamp locking mechanism spring having one end thereof secured to said protruding shaft, a collar connected to said shaft and interposed between said bushing block and said spring, and a pair of pins protruding from said collar each on an opposite side of said spring to retain said spring therebetween in order to prevent said spring from engaging said saw or said clamp carrier cam.

* * * * *